US007085507B2

(12) United States Patent
Cook et al.

(10) Patent No.: US 7,085,507 B2
(45) Date of Patent: Aug. 1, 2006

(54) METHOD AND APPARATUS TO CONTROL WASTE TONER COLLECTION IN AN IMAGE FORMING APPARATUS

(75) Inventors: William Paul Cook, Lexington, KY (US); Tom E Stickler, Lexington, KY (US); Larry Steven Foster, Lexington, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 175 days.

(21) Appl. No.: 10/647,420

(22) Filed: Aug. 25, 2003

(65) Prior Publication Data

US 2005/0047807 A1 Mar. 3, 2005

(51) Int. Cl.
*G03G 21/10* (2006.01)

(52) U.S. Cl. ..... 399/35; 399/36; 399/358

(58) Field of Classification Search ..... 399/34–36, 399/358, 360

See application file for complete search history.

(56) References Cited

U.S. PATENT DOCUMENTS

| | | | | |
|---|---|---|---|---|
| 3,483,679 | A | | 12/1969 | Balbierer |
| 3,924,566 | A | | 12/1975 | Dennie |
| 3,927,937 | A | | 12/1975 | de Keyzer |
| 4,029,047 | A | | 6/1977 | Bell |
| 4,030,824 | A | | 6/1977 | Smith |
| 4,251,155 | A | | 2/1981 | Schnall et al. |
| 4,281,918 | A | | 8/1981 | Fortmann |
| 4,436,413 | A | | 3/1984 | Oka |
| 4,530,594 | A | | 7/1985 | Adachi |
| 4,593,997 | A | | 6/1986 | Fox et al. |
| 4,601,569 | A | | 7/1986 | Garris |
| 4,627,716 | A | | 12/1986 | Oka |
| 4,630,653 | A | | 12/1986 | Kan |
| 4,650,312 | A | | 3/1987 | Vineski |
| 4,660,960 | A | | 4/1987 | Fukunaga et al. |
| 4,711,561 | A | | 12/1987 | Tsuruoka |
| 4,819,030 | A | | 4/1989 | Shibano |
| 4,819,578 | A | | 4/1989 | Koiso et al. |
| 4,849,791 | A | | 7/1989 | Hagihara et al. |
| 4,870,449 | A | | 9/1989 | Brown |
| 4,891,678 | A | | 1/1990 | Ishizu et al. |
| 4,941,022 | A | | 7/1990 | Ohmura et al. |
| 4,958,196 | A | | 9/1990 | Fujii et al. |
| 4,974,031 | A | | 11/1990 | Koiso et al. |
| 4,982,230 | A | * | 1/1991 | Ogura et al. ..... 399/35 |
| 4,982,231 | A | | 1/1991 | Matsuuchi |
| 4,985,734 | A | | 1/1991 | Honda et al. |
| 5,031,001 | A | | 7/1991 | Kusumoto |
| 5,113,227 | A | | 5/1992 | Miyasaka |
| 5,128,724 | A | | 7/1992 | Hayashi et al. |
| 5,130,756 | A | | 7/1992 | Taniyama |

(Continued)

*Primary Examiner*—William J. Royer
(74) *Attorney, Agent, or Firm*—Costa & Bennett, PLLC

(57) ABSTRACT

An image forming apparatus includes a waste toner system that collects waste toner in a waste toner container. An amount of waste toner collected in the container is increased by using a motor-driven toner distributing member that distributes accumulated toner within the container. The waste toner system may detect the accumulation of waste toner by monitoring a motor control circuit while the toner distributing member is being driven. For example, the system may detect excess accumulation by comparing the monitored values of a speed control signal with one or more reference values corresponding to nominal accumulation conditions. Whether or not the motor is speed controlled, the apparatus may use a shared motor that drives one or more image forming process members and the toner distributing member. A drive arrangement may be used to selectively drive the toner distributing member based on motor direction to avoid interfering with image forming operations.

50 Claims, 7 Drawing Sheets

U.S. PATENT DOCUMENTS 5,132,740 A 7/1992 Okamoto et al.
5,138,394 A 8/1992 Watanabe et al.
5,260,755 A 11/1993 Imaizumi
5,309,211 A 5/1994 Yoshioka
5,341,199 A 8/1994 Thorp et al.
5,355,199 A 10/1994 Bray
5,383,578 A 1/1995 Nishimura
5,400,127 A 3/1995 Arai et al.
5,440,376 A 8/1995 Hagihara
5,444,522 A 8/1995 Owens, Jr.
5,500,716 A 3/1996 Morishita et al.
5,534,988 A 7/1996 Gerbasi
5,541,714 A 7/1996 Watanabe et al.
5,585,894 A 12/1996 Araya et al.
5,594,541 A 1/1997 Bonislawski, Jr. et al.
5,617,195 A 4/1997 Torimaru et al.
5,634,186 A 5/1997 Villalobos-Garcia et al.
5,708,952 A 1/1998 Taniguchi et al.
5,875,382 A 2/1999 Inoue
5,918,085 A 6/1999 Rollins et al.
5,923,931 A 7/1999 Kishimoto
5,933,690 A 8/1999 Sugimoto et al.
5,937,235 A 8/1999 Huss et al.
5,995,774 A 11/1999 Applegate et al.
6,014,541 A 1/2000 Kato et al.
6,154,619 A 11/2000 Boockholdt et al.
6,266,511 B1 7/2001 Murakami et al.
6,298,217 B1 10/2001 Murayama et al.
6,308,036 B1 10/2001 Taniyama et al.
6,873,819 B1 * 3/2005 Ahn et al. ..... 399/360
2003/0044192 A1 3/2003 Brown et al.

* cited by examiner

METHOD AND APPARATUS TO CONTROL WASTE TONER COLLECTION IN AN IMAGE FORMING APPARATUS

BACKGROUND OF THE INVENTION

The present invention generally relates to an image forming apparatus, and particularly relates to waste toner collection in an image forming apparatus.

Image forming apparatus, such as electrophotographic (EP) printers or copiers, typically use a particulate developer material (toner) in their imaging operations. Such machines form output images by depositing toner onto a charged roller or other photosensitive member according to a latent print image and then running that toner to a media sheet.

Some amount of residual toner remains on the photosensitive member after image transfer and requires removal, such as by bringing a cleaning blade or other scraping mechanism into contact with the photosensitive member. The waste toner thus removed oftentimes is collected within a container included in the image forming apparatus. Potentially significant amounts of waste toner may be collected over time, particularly in machines that include multiple process cartridges, each of which acts as a source of waste toner.

SUMMARY OF THE INVENTION

The present invention comprises a method and apparatus to detect accumulation of waste toner in an image forming apparatus. In one or more embodiments, the present invention comprises a waste toner system for use in an image forming apparatus wherein a motor in the image forming apparatus drives a toner distributing member used to distribute accumulated waste toner more evenly within a waste toner container. An exemplary waste toner system comprises a motor control circuit configured to maintain the motor at a desired motor speed over a range of motor loads, and a logic circuit configured to detect accumulation of waste toner within the waste toner container by monitoring the motor control circuit.

For example, the motor control circuit may be configured to vary a speed control signal as needed to maintain a desired motor speed. With that, the logic circuit may be configured to detect accumulation of waste toner by comparing one or more values of the speed control signal generated by the motor control circuit while driving the toner distributing member to one or more stored reference values corresponding to nominal waste toner accumulation conditions.

While not limiting the present invention, the above configuration may offer particular advantages when implemented using a shared motor arrangement. For example, where the image forming apparatus includes a motor to drive one or more image forming process members, that motor also may be used to drive the toner distributing member. Thus, the logic circuit of the waste toner system may be configured to monitor a motor control circuit used in both image forming and toner distributing operations. If the shared motor includes a motor control circuit to regulate its speed, that circuit also may be shared with the waste toner system.

In an exemplary shared motor configuration, the waste toner system may further comprise a drive apparatus including a first drive apparatus to drive the image forming process member in forward and reverse directions of the shared motor, and a second drive apparatus to selectively engage the first drive apparatus to thereby drive the toner distributing member in one motor direction but not in the other motor direction. For example, where a media alignment roller motor is used as the shared motor, the toner distributing member may be disengaged during forward rotation of the roller, e.g., the media feeding direction, to avoid adding additional loading at those times.

Independent of motor sharing and drive details, an exemplary toner distributing member comprises a reciprocating toner rake, such that the logic circuit may detect accumulation of waste toner within the waste toner container by monitoring values of a speed control parameter generated by the motor control circuit over one or more raking cycles of the toner rake. For example, the logic circuit may detect a near full condition of the waste toner container by determining a difference between one or more values of the speed control parameter generated during one or more forward strokes of the toner rake and one or more values of the speed control parameter generated during one or more reverse strokes of the toner rake. Similarly, the logic circuit may detect a near full condition of the waste toner container based on determining a difference between maximum and minimum values of the speed control parameter generated over one or more raking cycles of the toner rake.

Of course, the above information is not comprehensive in terms of describing all of the features and advantages of the present invention in its various exemplary embodiments. Those skilled in the art will recognize additional features, advantages, and opportunities for variation upon reading the following details and examining the associated illustrations.

DETAILED DESCRIPTION OF THE INVENTION

Figure 1:
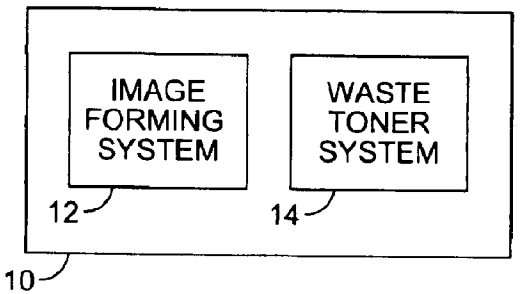
FIG. 1 is a diagram of an exemplary image forming apparatus in which the present invention may be embodied.

FIG. 1 presents a much-simplified illustration of an image forming apparatus 10 as comprising an image forming system 12 and a waste toner system 14. Of course, the two systems as a matter of practical implementation may not actually be implemented in such cleanly separated fashion in an actual image forming apparatus 10. Thus, it should be understood that FIG. 1 provides a basis for beginning a discussion of exemplary details rather than as a literal depiction of any electromechanical and electro-optical systems within image forming apparatus 10. One may refer to the "C750" series electrophotographic (EP) printer manufactured by Lexmark International, Inc., for an example of image forming apparatus details.

Regardless of its specific implementation details, image forming apparatus 10 uses a consumable developer material, such as particulate toner, to form desired images on media sheets processed by it. Thus, image forming apparatus 10 may be a "laser" printer, copier, facsimile, etc. During imaging operations, image forming apparatus 10 forms desired images, e.g., text, graphics, etc., by transferring developer from one or more image transfer members, such as rotating photoconductive drums, to copy sheets or other media being fed through the image forming apparatus 10. Residual developer material is scoured or otherwise cleaned from the image transfer members between image forming operations to maintain the requisite print quality. This residual developer material, which broadly is referred to as "waste toner" herein, is collected within image forming apparatus 10 in a controlled fashion.

For purposes of this discussion, the image forming details are not important to understanding the present invention. Rather, the focus properly is on the waste toner system 14 in terms of its operations vis-à-vis the waste toner being accumulated in the image forming apparatus 10. In selected embodiments, the discussion further focuses on the cooperative sharing of elements between the image forming system 12 and the waste toner system 14.

Figure 2:
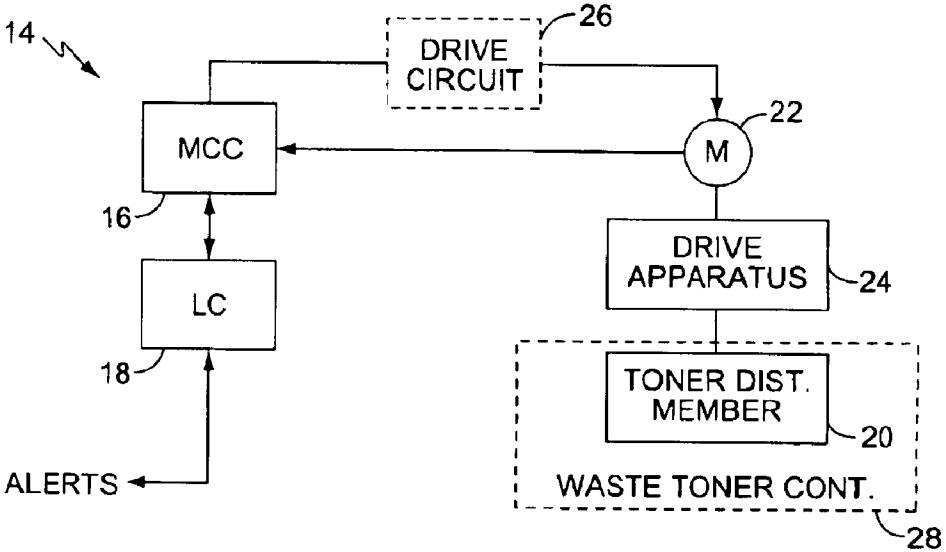
FIG. 2 is a diagram of an exemplary waste toner system.

FIG. 2 illustrates an exemplary waste toner system 14 comprising a motor control circuit (MCC) 16 and a logic circuit (LC) 18, and that further includes, or at least is associated with, a toner distributing member (TDM) 20, a motor (M) 22, a drive apparatus 24, and a motor drive circuit 26. As illustrated, the TDM 20 is movably positioned within a waste toner container 28 although other arrangements are contemplated.

In operation, waste toner produced from ongoing imaging operations of the image forming apparatus 10 is conveyed to and collected in waste toner container 28. Thus, waste toner accumulates in container 28 and at some point container 28 must be removed and emptied or replaced. As this represents an ongoing point of service, it is desirable to accumulate as much waste toner as possible in container 28 before requiring its removal. In other words, it is desirable to fully use the volumetric capacity of container 28 for the collection of waste toner.

Although it may be difficult to achieve a 100% packing efficiency, TDM 20 greatly aids in the efficient use of the interior volume of container 28 by "spreading" or otherwise distributing accumulated toner within the interior of container 28. Motor 22 drives TDM 20 via drive apparatus 24 such that the TDM 20 oscillates, vibrates, rotates, reciprocates, or otherwise moves within container 28 to accomplish the desired spreading of accumulated waste toner therein.

Even aided by the spreading operations of TDM 20, container 28 eventually reaches a "full" condition after which no additional waste toner should be collected in it. Indeed, one or more exemplary embodiments of the present invention prohibit additional image forming operations until the full condition, once detected, is relieved. Such prohibition avoids overfilling the waste container and reduces the possibility of contaminating the interior of image forming apparatus 10 with waste toner overflow.

An exemplary embodiment of the waste toner system 14 detects the full condition of container 28 based on monitoring MCC 16 while motor 22 is driving the TDM 20. Waste toner system 14 also may detect a "near full" condition of container 28 to gain the valuable benefit of alerting users of image forming apparatus 10 that container 28 is nearing its capacity limit. Both conditions may be detected, for example, by monitoring one or more control signals of MCC 16 while it is controlling motor 22 during toner distributing operations. It should be noted that such monitoring may be based on analog or digital signals and that the present invention contemplates a variety of monitoring schemes.

Figure 3:
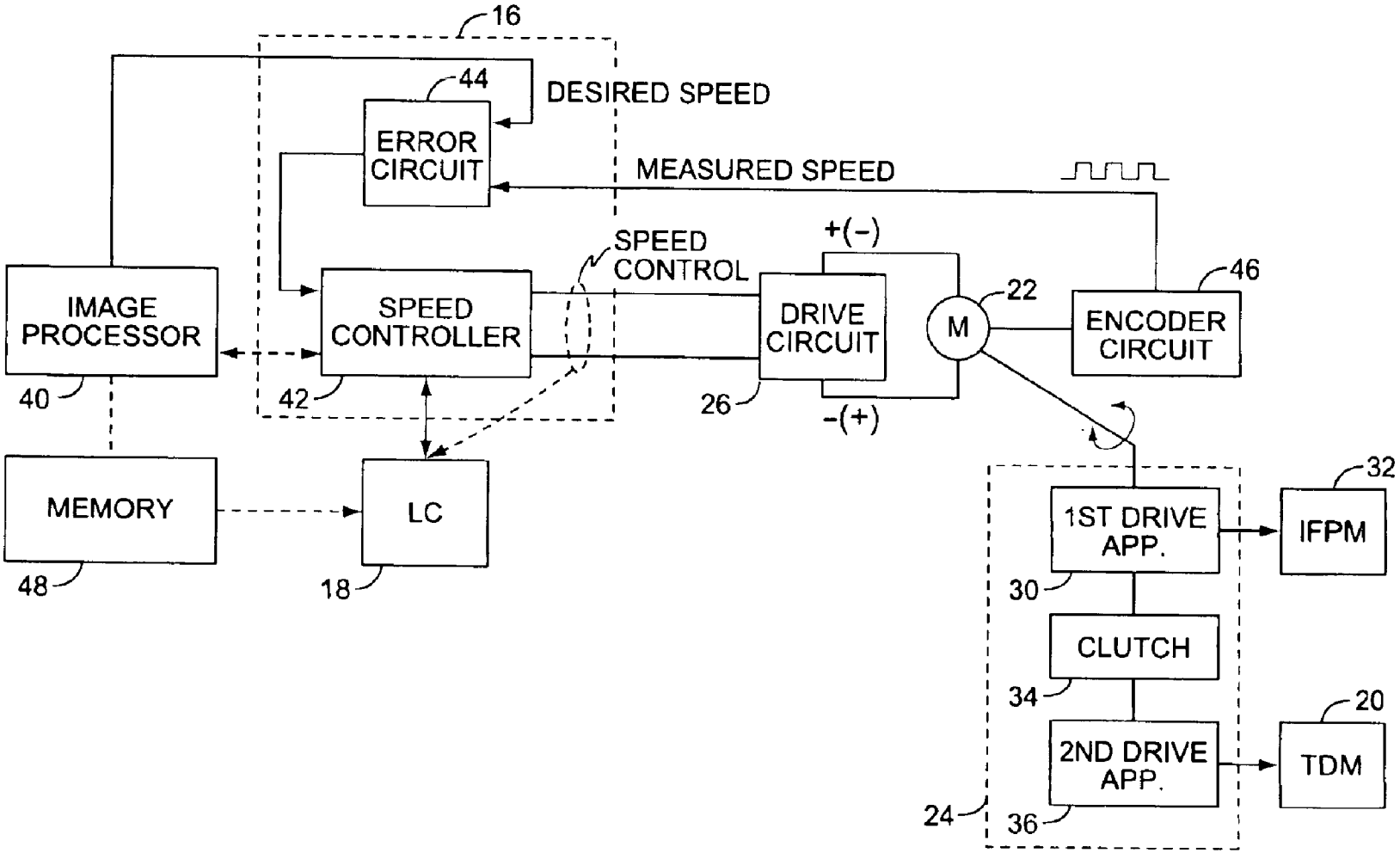
FIG. 3 is a diagram of another exemplary waste toner system.

FIG. 3 illustrates another exemplary waste toner system 14, wherein motor 22 comprises a shared motor used in image forming operations as well as in toner spreading operations. An exemplary drive apparatus 24 thus drives an image forming process member (IFPM) 32 and TDM 20, and includes a first drive apparatus 30 to drive IFPM 32, and further includes a selective engagement device (e.g., one-way clutch) 34 to selectively drive a second drive apparatus 36 that is coupled to TDM 20. Note that in some embodiments, IFPM 32 may function as an element of drive apparatus 30 such that clutch 34 is driven by the rotation of IFPM 32, for example. FIG. 3 further illustrates an image processor 40, a speed controller 42 and error circuit 44 within MCC 16, an encoder circuit 46, and one or more storage elements (e.g., memory device(s)) 48.

In exemplary operation, MCC 16 controls the direction and speed of motor 22 based on an output speed control signal generated by the MCC 16. In an exemplary embodiment, speed controller 42 comprises a Pulse Width Modulation (PWM) controller that generates an output pair of PWM signals wherein, as is well understood in the art, the relative pulse polarities control the direction of motor 22 and the pulse widths control the speed of motor 22.

As motor 22 turns, encoder circuit 46 generates a feedback signal that indicates motor speed. The signal may be a proportional analog signal or may be a digital signal. For example, encoder circuit 46 may comprise a photo-interrupter based encoder circuit that generates output pulses at a frequency related to the motor's rotational speed. Error circuit 44 of MCC 16 receives the speed feedback signal as one input and receives a reference (desired speed) signal as a second input. The error signal output by error circuit 44 indicates error between actual and desired motor speed, and thus serves as a control input to speed controller 42. MCC 16 thus functions as a feedback control circuit configured to vary its output speed control signal as needed to maintain a desired motor speed over a range of motor loads.

In a PWM-based embodiment, speed controller 42 may comprise an n-bit PWM generator that controls motor speed by varying the duty cycle of its output PWM from about 0% to about 100% as needed to maintain the desired motor speed. N-bit PWM control provides $2^n-1$ pulse width adjustment resolution, so an exemplary 16-bit PWM controller offers a numerical control range from 0 to 65,535. With this approach, speed controller 42 may be loaded with a PWM value corresponding to a desired motor speed and, in operation, adjust that value up or down as needed based on the error signal from error circuit 44. Thus, the speed control signal monitored by logic circuit 18 may be the "live" PWM value of speed controller 42, which may be provided to logic circuit 18 as a digital value, or logic circuit 18 may monitor the output PWM signals.

An exemplary drive circuit 26 may be implemented as an H-bridge motor drive circuit comprising a transistor-based push-pull arrangement that allows polarity reversal across motor 22 to enable operation in forward or reverse motor directions as desired. Those skilled in the art will appreciate that speed controller 42 may generate a speed control signal as a complementary pair of PWM waveforms to drive the H-bridge transistors. The natural impedance of motor 22, which may be a dc motor, acts as a low-pass filter to average the PWM pulses applied to drive circuit 26 such that the average drive voltage across the motor is a function of the modulated pulse width and frequency. The RS385-15155 dc motor manufactured by MABUCHI MOTOR AMERICA CORP., which maintains a business address of 3001 West Big Beaver Road, Suite 520, Troy, Mich. 48084 U.S.A., represents an exemplary dc motor.

Such speed control complements the shared-motor drive arrangement. In the illustrated shared-motor embodiment, drive apparatus 24 drives both IFPM 32 and TDM 20 when motor 22 rotates in one direction, and drives only IFPM 32 when the motor 22 rotates in the other direction. To accomplish this, clutch 34 is configured to engage second drive apparatus 36 when the motor 22 drives the first drive apparatus 30 in one direction of rotation, and disengage second drive apparatus 36 when motor 22 drives it in the other direction.

For example, if IFPM 32 comprises a bump/alignment roller used in the image forming process to feed in and align media sheets prior to image formation, one rotational direction of motor 22 corresponds to a forward process direction and the other direction of motor 22 corresponds to a reverse process direction. Thus, clutch 34 of drive apparatus 24 may be configured disengage second drive apparatus 36 in the forward process direction and engage second drive apparatus 36 in the reverse process direction. In that embodiment, motor 22 is not loaded by TDM 20 during potentially sensitive bump/alignment operations associated with driving IFPM 32 in the forward process direction. Rather, TDM 20 is driven whenever motor 22 runs in the less sensitive reverse process direction. Of course, this drive logic may change depending on how motor 22 is shared with the image forming system 12.

Regardless, logic circuit 18 may detect the accumulation of waste toner within container 28 by monitoring MCC 16 while the motor 22 is driving TDM 20. For example, until enough waste toner accumulates to begin interfering with movement of TDM 20, the MCC 16 should not have to substantially vary its speed control signal away from a nominal value to maintain the desired motor speed while driving TDM 20. Once waste toner accumulates in container 28 to the point where it begins interfering with the free movement of TDM 20, however, MCC 16 may have to adjust its speed control signal more substantially to maintain the desired motor speed.

Thus, in an exemplary embodiment, logic circuit 18 is programmed with, or has access to, one or more reference values, e.g., PWM value(s), corresponding to nominal waste toner accumulation conditions. In one embodiment, memory device(s) 48 store PWM reference values and may store other information, such as detection thresholds, etc. Reference values may be obtained, for example, by observing the speed control signal value needed to maintain a desired motor speed while driving TDM 20 with an empty container 28. By monitoring the PWM value(s) actually generated by MCC 16 while driving TDM 20, and comparing those monitored values to one or more reference values, logic circuit 18 may detect when (and to what extent) excess accumulated waste toner has begun interfering with the movement of TDM 20.

Logic circuit 18 may provide the desired speed information to MCC 16, or it may be provided by the image processor 40. Indeed, because logic circuit 18 may be implemented using a microprocessor configured to execute coded program instructions, logic circuit 18 may be incorporated into imaging processor 40. Of course, it should be understood that logic circuit 18 may be implemented as discrete logic, or as a stand-alone microprocessor or other programmable device, etc., and that, in general, it may be implemented in hardware, software, or some combination thereof. Similarly, MCC 16 may be implemented in hardware, software, or some combination thereof, and may be integrated with other function elements or implemented as a stand alone circuit, as needed or desired.

The inclusion of logic circuit 18 within image processor 40, which may be referred to as a "Raster Imaging Processor" or RIP, is beneficial in that image processor 40 already includes the necessary logic to interact with and monitor MCC 16 because of its need to control motor 22 during imaging operations involving the IFPM 32. For example, image processor 40 may require that IFPM 32 be moved or rotated according to precise velocity profiles that ensure synchronization of IFPM 32 within the overall image forming process.

Figure 4:
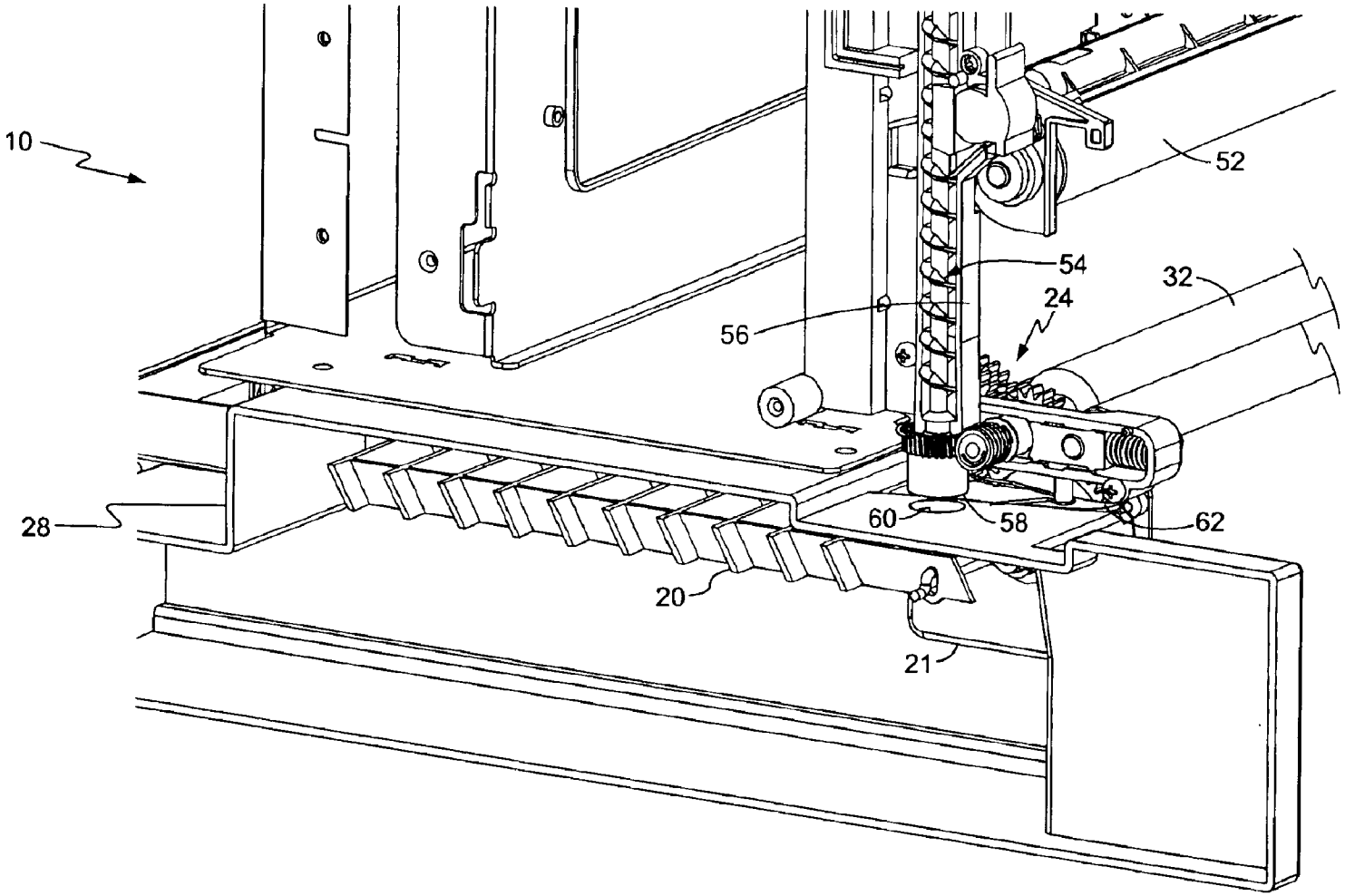
FIG. 4 is a diagram of selected elements of an exemplary waste toner system shown in perspective view within an exemplary image forming apparatus.

To better understand an exemplary embodiment of these detection operations, FIG. 4 provides a perspective view of selected details for image forming apparatus 10. An exemplary waste toner system 14 is configured to accumulate waste toner resulting from the imaging operations and includes motor 22 shared by the image forming and waste toner systems 12 and 14, respectively, waste toner container 28, toner distributing member 20, MCC 16, logic circuit 18, drive apparatus 24, and one or more waste toner transport members configured to receive waste toner from the image forming system 12 and transport the received waste toner to the waste toner container 28.

In the illustrated embodiment, the TDM 20 comprises a horizontally reciprocating toner rake 20 that is movably positioned at an upper elevation within container 28. A reciprocating arm 21 couples rake 20 to a drive gear (not shown here), which forms a part of drive apparatus 24.

The waste toner transport members include a vertical screw auger 54 enclosed within a vertical shaft (tube) 56. During imaging operations, residual toner is removed from one or more image transfer members 52. The waste toner is conveyed downward by screw auger 54. The terminal end 58 of shaft 56 is aligned with an inlet 60 formed as a topside opening into container 28 (note that a seal would typically be used to close any gap between shaft 56 and inlet 60). Thus, collected waste toner flows downward through shaft 56, through inlet 60 and falls into container 28. Absent operation of the toner rake 20, the accumulated waste toner would tend to pile up in container 28 in the area below inlet 60.

In an exemplary embodiment of the present invention, motor 22 is used to drive rake 20 at a desired motor speed. Within its control range, MCC 16 varies a speed control signal as needed to maintain motor 22 at the desired speed while driving rake 20. Therefore, logic circuit 18 may be configured to detect accumulation of waste toner by monitoring the speed control signal, which changes in a characteristic fashion as excess accumulated waste toner begins interfering with movement of toner rake 20.

In one embodiment, memory device 48 holds a characteristic value (or values) for the speed control signal that correspond to nominal accumulation conditions. In this context, nominal accumulation conditions denote accumulation levels below the point at which accumulated toner begin to impede movement of rake 20 in any substantial sense. Thus, logic circuit 18 may record the value or values observed for the speed control signal generated by the MCC 16 while driving toner rake 20 with an empty container 28. Logic circuit 18 could update those reference values over time to account for changing characteristics, such as increased wear on drive apparatus 24, although the reference range should not change that much with normal wear. Therefore, image forming apparatus 10 could be pre-programmed with the proper reference value(s), which could involve loading them into configurable memory or hard-coding them into a computer program that implements the detection logic of the present invention.

In any case, an exemplary speed-control based detection method is implemented as follows. During the times when motor 22 is driving rake 20, the logic circuit 18 monitors a speed control signal generated by MCC 16 to detect accumulation. Such monitoring may be based on logic circuit 18 monitoring analog or digital control values, output values, etc. In an exemplary embodiment, logic circuit 18 monitors PWM control values generated by MCC 16 to vary the drive voltage of motor 22 as needed to maintain the desired motor speed.

With 16-bit PWM control, for example, a digital control word may be varied from 0 (0% duty cycle) to 65,535 (100% duty cycle). A nominal driving value may be, for example, a midpoint value of 32,767. Therefore, by monitoring the differences between nominal and actual values and/or by monitoring changes in the actual values during toner spreading operations, the logic circuit 18 can determine whether excess toner has accumulated within waste toner container 28. In other embodiments, logic circuit 18 may monitor some other speed control parameter used in the feedback control loop of MCC 16, and thus may simply receive one or more digital values generated by MCC 16 as part of its speed control operation. Regardless, logic circuit 18 can detect whether accumulated waste toner is interfering with rake movement by comparing the monitored values to the appropriate stored reference values.

If the difference between the monitored and reference values is large, indicating that MCC 16 is applying an increased drive voltage to motor 22 to maintain the desired speed, logic circuit 18 may infer that accumulated waste toner has begun impeding rake movement. In particular, in an exemplary embodiment, logic circuit 18 monitors the MCC 16 over one or more raking cycles, wherein a raking cycle comprises the forward and corresponding reverse reciprocating movement of the rake 20.

As excess waste toner accumulates to the level of rake 22, its forward movement tends to push the top of the toner pile away from the outlet, which thereby causes it to fall away from peak of the pile and thereby spread out. As long as open space remains below the rake 20, then, the return stroke of the rake 20 will be relatively unimpeded. Note that an exemplary rake design may include angled raking elements to enhance raking in the direction away from the toner inlet area of container 28.

Logic circuit 18 may detect a near full condition by comparing one or more speed control values generated during the forward stroke of rake 20 with one or more values generated during the return (reverse) stroke. (Note that logic circuit 18 may average forward and reverse values over several raking cycles and compare averaged forward and reverse values.) If the speed control values corresponding to forward and reverse rake movements exhibit a characteristic difference, logic circuit 18 may infer that the waste toner container 28 is in a near full condition. The logic circuit 18 may generate a near full signal and communicate that signal to image processor 40 (or to another processing system in image forming apparatus 10). In an exemplary embodiment, image forming apparatus 10 alerts users to the near full condition by displaying a message, light, emitting an audio alert, etc., which gives users a chance to empty the container 28 before it fills completely.

Similarly, logic circuit 18 may detect a full condition of container 28 by detecting that the speed control values generated for forward and reverse rake strokes exceed a threshold corresponding to nominal accumulation conditions. If rake 20 encounters resistance on both forward and reverse rake strokes, logic circuit 18 may infer that excess waste toner has accumulated to the point where there is little free space remaining within container 28. Logic circuit 18 may generate a full condition signal that may be used to cause image forming apparatus 10 to prohibit image forming operations until container 28 is removed and emptied or replaced.

Those skilled in the art will appreciate that the present invention contemplates various refinements of the above monitored-to-reference value comparisons. For example, the maximum and minimum values of one rake cycle, or the averaged maximum and minimum values developed over two or more raking cycles, may be compared to a reference value indicative of nominal accumulation conditions. If both the maximum and minimum monitored values exceed the nominal value by a defined threshold (or thresholds), then the logic circuit 18 may deem the container 28 full.

One or more hysteresis bands could be used to prevent false full or near-full detections, or to otherwise smooth out the detection response. Alternatively, or additionally, a tolerance could be built into the nominal value, such as by storing a range of values, or a tolerance could be applied on the fly by scaling the nominal value by +5% for example to arrive at a threshold value for comparison to monitored values.

In any case, in addition to illustrating rake 20, FIG. 4 also illustrates at least a portion of its associated drive apparatus 24 and thus provides a basis for discussing exemplary drive apparatus details. More particularly, FIG. 3 illustrated the use of motor 22 as a shared motor for the dual benefit of speed-controlled motor operation during both image forming and toner spreading operations. The diagram also introduced additional drive apparatus details indicating that a first drive apparatus 30 may be used to drive IFPM 32 and that a second drive apparatus 36 may be used to drive the TDM 20.

In fact, whether or not motor 22 is speed-controlled, the schematic and diagrammatic representations of FIGS. 3 and 4 illustrate an exemplary drive apparatus 24 that allows essentially any type of motor to be shared by the image forming system 12 and the waste toner system 14 in a manner that avoids potential interference with precision motor operation during imaging operations. Specifically, clutch 34 may be used to engage the second drive apparatus 36 on a selective basis as a function of the motor's direction of rotation.

Figure 5:
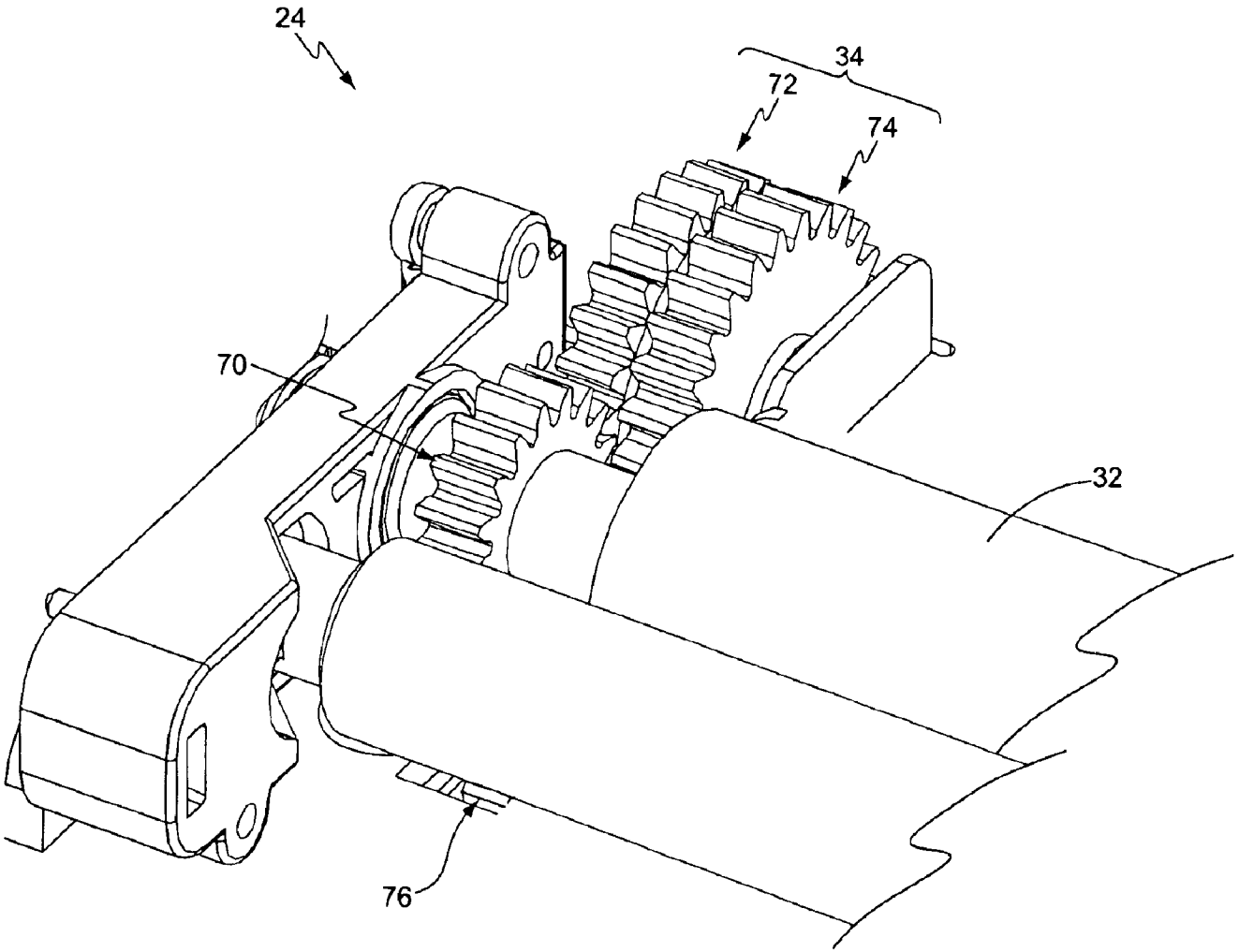
FIG. 5 is a diagram of selected elements of an exemplary drive apparatus shown in perspective view.

FIG. 5 illustrates the same end of IFPM 32 as shown in FIG. 4 but provides more details regarding an exemplary gear arrangement. IFPM 32 may be a media alignment roller, for example, that is used to feed media sheets into an image forming path (not shown) of the image forming system 12. As such, the roller is operated in a forward direction (relative to the feed direction of the media) to feed media sheets into the image forming system 12. When operating in the forward direction, it may be undesirable from a motor control perspective, to subject shared motor 22 to the additional (and potentially variable) load associated with driving the TDM 20.

Thus, one-way clutch 34 is configured to engage the first drive apparatus 30 with the second drive apparatus 36 when the motor 22 rotates in the reverse process direction, where control of IFPM 32 is not critical to image formation timing, but not in the forward process direction. The forward and reverse directions of motor 22 thus should be understood as referring to the process-related operation of IFPM 32. FIG. 5 provides more detail.

In FIG. 5, one sees a drive pinion 70 attached at one end of IFPM 32—the motor 22 is coupled to the other end—and that pinion 70 engages a first gear 72 of clutch 34. Thus, rotation of IFPM 32 by motor 22 in either direction causes a counter rotation of gear 72. A second gear 74 is positioned adjacent to and on the same rotational axis of gear 72. The interior faces of adjacent gears 72 and 74 are configured such that gear 72 engages gear 74 in one direction of rotation but not in the other. With this configuration, then, gear 74 drives gear 76 if the motor 22 rotates in one direction, but not when it rotates in the other direction. Gear 76 is coupled to rake drive arm 21 shown in FIG. 4 and, thus, the TDM 20 is driven in one motor direction but not the other. Of course, those skilled in the art immediately will appreciate that other selective engagement drive arrangements may be used as needed or desired.

Figure 6:
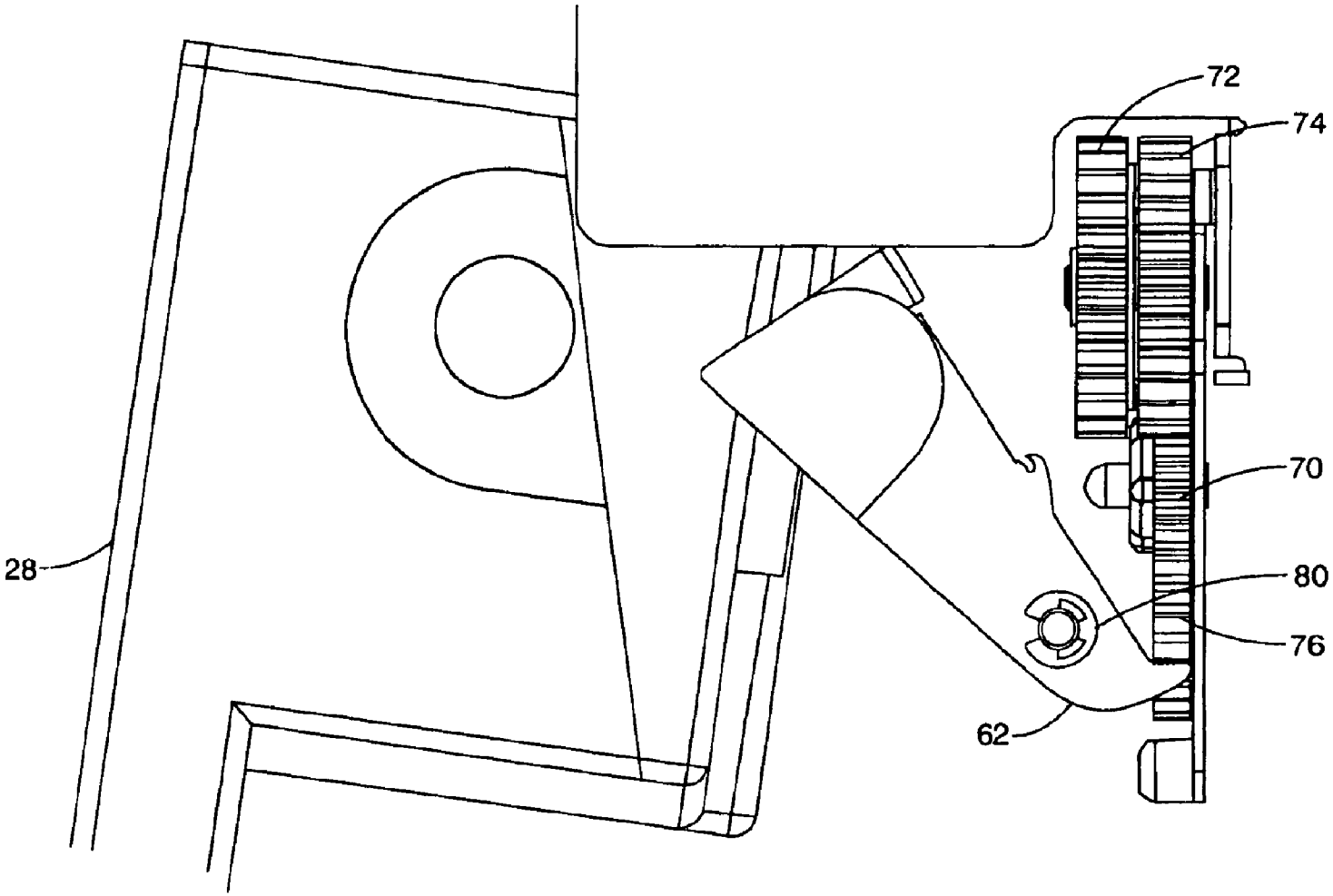
FIG. 6 is a diagram of selected elements of an exemplary drive apparatus, including an exemplary drive locking system, shown in plan view.
Figure 7:
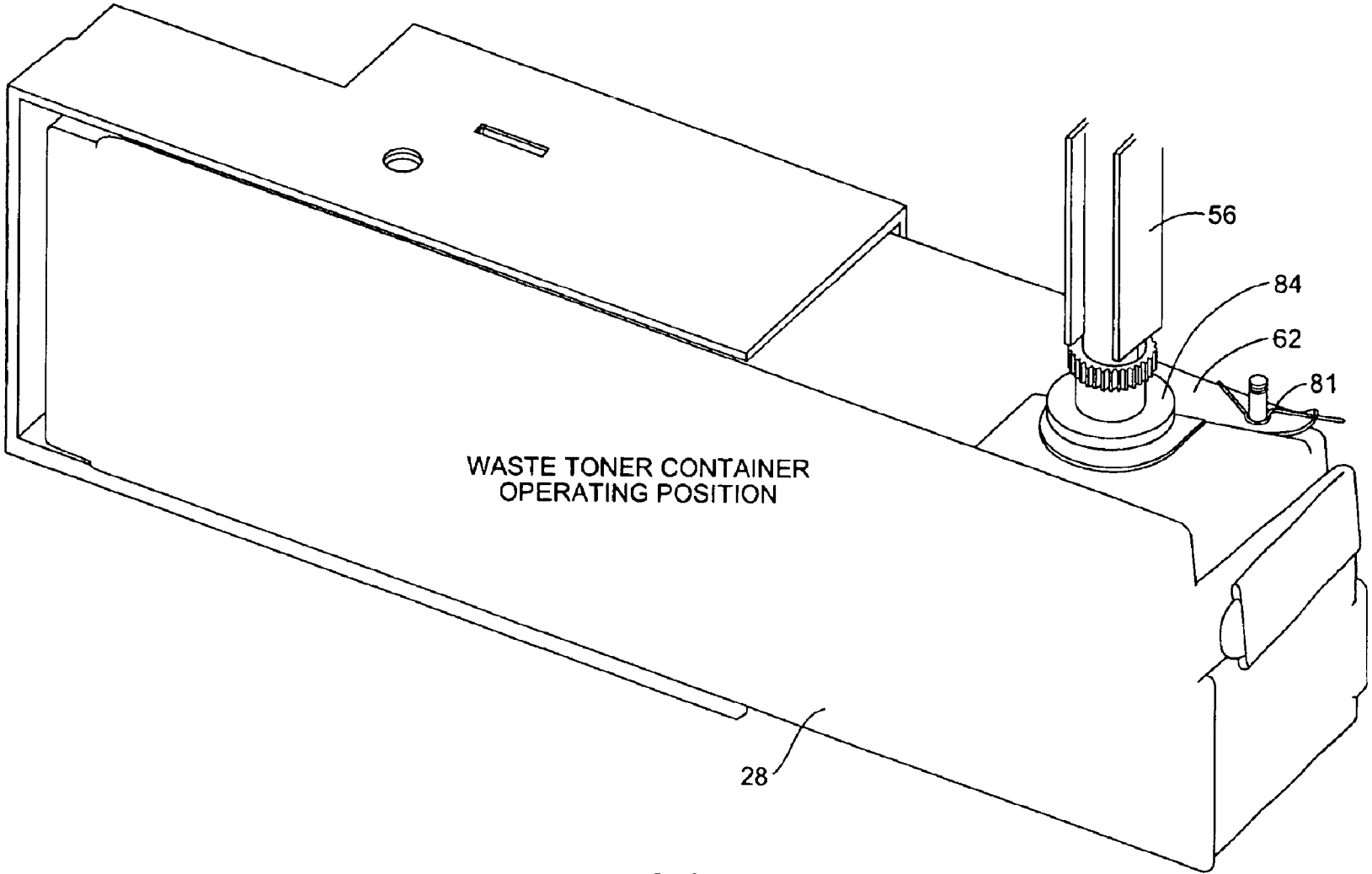
FIG. 7 is a diagram of an exemplary waste toner container shown in perspective view.

In an exemplary addition to drive apparatus 24, FIG. 6 illustrates the inclusion of a locking system 62 first illustrated in FIG. 4. FIG. 7 illustrates substantially the same details with the container 28 installed. The locking system 62 is depicted as a pivoting arm that is moved into a disengaged (unlocked) position if container 28 is present and is moved into an engaged (locked) position if container 28 is absent. Specifically, a retaining ring 80 pivotally retains an arm comprising locking system 62 such that it swings into and out of engagement with drive gear 76 (discussed in the context of FIGS. 4 and 5). Note that a spring 81 or other biasing member may be used to urge the arm of locking system 62 into engagement responsive to removal of container 28. Note, too, that a seal 84 may be used to seal any gap between the terminal end 58 of shaft 56 and the inlet 60 opening into container 28.

In operation, drive gear 76, which couples to TDM 20 via drive arm 21, becomes locked by locking system 62 when container 28 is removed from the image forming apparatus 10. Logic circuit 18 and/or MCC 16 may be configured to include stall detection logic, wherein MCC 16 de-energizes motor 22 responsive to its detection of the locked drive condition. The locked drive condition may be detected by, for example, observing a zero measured motor speed irrespective of the speed control signal output by MCC 16.

The locking arrangement illustrated is advantageous in that it also locks the machine elements involved in conveying waste toner downward from the image forming member(s) and prevents dumping waste toner into the open area normally occupied by container 28. Note that imaging may be prohibited responsive to detecting the locked condition.

Figure 8:
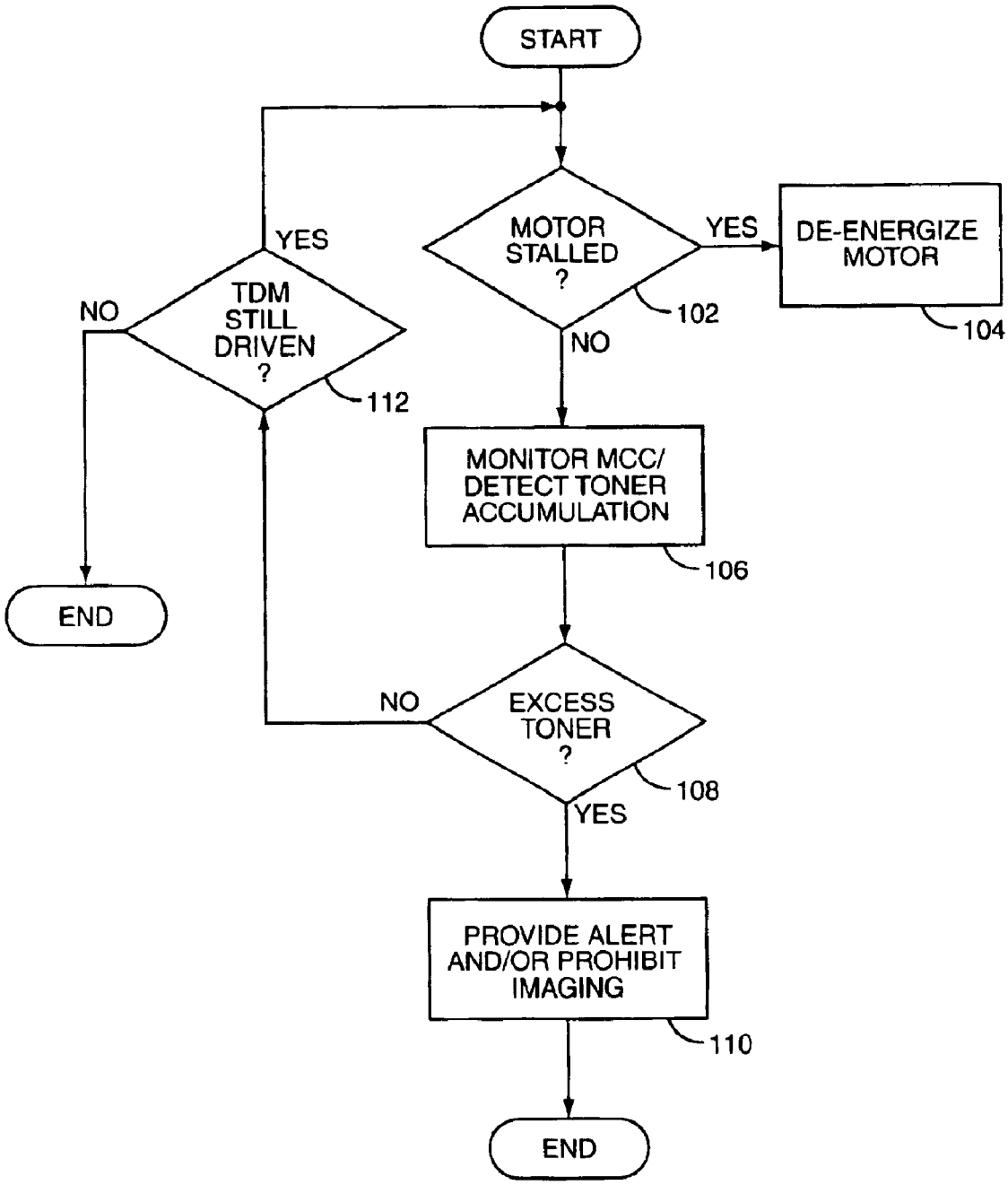
FIG. 8 is a diagram of exemplary processing logic for one or more embodiments of the present invention.

FIG. 8 illustrates exemplary processing logic that may be implemented by waste toner system 14. Assuming that a command has issued to begin running motor 22 at a desired speed for purposes of driving TDM 20, processing starts with the detection of a motor stall condition (Step 102). If the motor 22 is stalled, MCC 16 de-energizes motor 22 (Step 104) to avoid stressing it and/or stressing drive apparatus 24. Here, de-energizing motor 22 may be achieved by, for example, outputting zero width PWM pulses or by removing the source voltage (supply voltage) from motor 22.

If motor 22 is not stalled, processing continues with logic circuit 18 monitoring MCC 16 to detect toner accumulation, as explained above (Step 106). If excess toner accumulation is detected (Step 108), waste toner system 14 provides an alert (e.g., full or near-full), which may be used to warn users and/or prohibit printing (Step 110). If excess toner accumulation is not detected, processing continues with determining whether continued toner distributing operations are desired (Step 112). If so, MCC 16 continues running motor 22 at the desired speed and monitoring/detection continues. Note that the detection operations need not run continuously and may be activated on a periodic basis keyed to time of operation and or the amount of printing activity.

Regarding printing activity, waste toner system 14 may be configured to gain additional toner spreading operations by running motor 22 at times selected not to interfere with imaging operations. For example, where motor 22 drives IFPM 32 and TDM 20 in a reverse process direction, and drives only IFPM 32 in a forward process direction, the waste toner system may find times during or between selected image processing operations in which to run the motor 22 in the reverse direction. Thus, even if the image forming operations naturally require selected reversing of motor 22, the total amount of time that motor 22 is run in reverse intentionally may be extended at selected opportunities to enhance the spreading action of TDM 20.

Of course, those skilled in the art will recognize other potential opportunities to gain additional advantages, and it should be understood that the present invention is not limited by the foregoing discussion, or by the accompanying illustrations. Indeed, the present invention is limited only by the following claims and the reasonable equivalents thereof.

What is claimed is:

1. An image forming apparatus comprising:

an image forming system configured to perform imaging operations;

a waste toner system configured to accumulate waste toner resulting from the imaging operations; and a motor shared by the image forming and waste toner systems;

said waste toner system comprising:

a waste toner container to accumulate waste toner; and a toner distributing member that is driven by the shared motor to distribute accumulated waste toner.

2. The image forming apparatus of claim 1, wherein the waste toner system further comprises:

a motor control circuit to control the shared motor; and a logic circuit to detect accumulation of waste toner based on monitoring the motor control circuit while the shared motor is driving the toner distributing member.

3. The image forming apparatus of claim 2, wherein the motor control circuit comprises a speed control circuit configured to maintain the shared motor at a desired speed over a range of loading conditions, and wherein the logic circuit detects accumulation of waste toner by monitoring values of a speed control signal generated by the motor control circuit while the shared motor is driving the toner distributing member at a substantially fixed motor speed.

4. The image forming apparatus of claim 1, further comprising a drive apparatus that couples the shared motor to an image forming process member of the image forming system and to the toner distributing member, the drive apparatus comprising a selective engagement device to drive the toner distributing member in one direction of shared motor rotation but not in the other direction of share motor rotation.

5. The image forming apparatus of claim 1, further comprising a locking system that locks and unlocks a drive apparatus associated with the toner distributing member responsive to removal and replacement, respectively, of the waste toner container from the image forming apparatus.

6. The image forming apparatus of claim 5, further comprising detection logic to detect a locked condition of the drive apparatus based on detecting a stall condition of the shared motor.

7. The image forming apparatus of claim 1, wherein the waste toner system further comprises one or more waste toner transport members configured to receive waste toner from the image forming system and transport the received waste toner to the waste toner container.

8. A waste toner system for use in an image forming apparatus wherein a motor in the image forming apparatus drives a toner distributing member used to distribute waste toner within a waste toner container, the waste toner system comprising:

a motor control circuit configured to maintain the motor at a desired motor speed over a range of motor loads; and a logic circuit configured to detect accumulation of waste toner within the waste toner container by monitoring the motor control circuit.

9. The waste toner system of claim 8, wherein the logic circuit detects accumulation of waste toner within the waste toner container based on monitoring a speed control signal that is varied as needed by the motor control circuit to maintain the motor substantially at a desired speed while the motor is driving the toner distributing member.

10. The waste toner system of claim 8, wherein the motor control circuit is configured to vary a speed control signal as needed to maintain a desired motor speed, and wherein the logic circuit detects accumulation of waste toner by comparing one or more values of the speed control signal generated by the motor control circuit while driving the toner distributing member to one or more stored reference values corresponding to nominal waste toner accumulation conditions.

11. The waste toner system of claim 8, further comprising a locking system to lock a toner distributing member drive apparatus if the waste toner container is not present, and wherein the waste toner system is configured not to drive the toner distributing member responsive to detecting a locked condition of the toner distributing member drive apparatus.

12. The waste toner system of claim 8, wherein the logic circuit generates a full condition signal responsive to detecting a full condition of the waste toner container, whereupon the image forming apparatus prohibits image forming operations.

13. The waste toner system of claim 8, wherein the logic circuit generates a near full condition signal responsive to detecting a near full condition of the waste toner container, whereupon the image forming apparatus provides a near full warning to alert users of the image forming apparatus.

14. The waste toner system of claim 8, wherein the toner distributing member comprises a reciprocating toner rake, and wherein the logic circuit is configured to detect accumulation of waste toner within the waste toner container based on monitoring values of a speed control parameter generated by the motor control circuit over one or more raking cycles of the toner rake.

15. The waste toner system of claim 14, wherein the logic circuit detects a near full condition of the waste toner container by determining a difference between one or more values of a speed control parameter generated during one or more forward strokes of the toner rake and one or more values of the speed control parameter generated during one or more reverse strokes of the toner rake.

16. The waste toner system of claim 14, wherein the logic circuit detects a near full condition of the waste toner container based on determining a difference between maximum and minimum values of the speed control parameter generated over one or more raking cycles of the toner rake.

17. The waste toner system of claim 14, wherein the logic circuit detects excess accumulation of waste toner by comparing values of the speed control parameter generated over one or more raking cycles to one or more stored reference values corresponding to nominal waste toner accumulation conditions.

18. The waste toner system of claim 8, further comprising a drive apparatus coupled to the motor, the drive apparatus comprising:

a first drive apparatus configured to drive an image forming process member of the image forming apparatus in forward and reverse motor directions; and a second drive apparatus configured to drive the toner distributing member in one of the forward and reverse motor directions.

19. The waste toner system of claim 18, wherein the drive apparatus includes a one-way clutch coupling the second drive apparatus to the first drive apparatus, such that the first drive apparatus engages the second drive apparatus in one but not the other motor direction.

20. A waste toner system for use in an image forming apparatus wherein a motor in the image forming apparatus drives a toner distributing member used to distribute waste toner within a waste toner container, the waste toner system comprising:

a motor control circuit to vary a speed control signal as needed to maintain a desired motor speed; and a logic circuit to detect excess accumulation of waste toner within the waste toner container by comparing one or more values of the speed control signal while the motor is driving the toner distributing member with one or more reference values corresponding to a nominal accumulation condition.

21. The waste toner system of claim 20, wherein the toner distributing member forms a part of the waste toner system and comprises a reciprocating toner rake movable in forward and reverse raking directions within the waste toner container.

22. The waste toner system of claim 21, wherein the logic circuit detects a near full condition of the waste toner container by detecting a difference between values of the speed control signal generated during forward and reverse portions of one or more toner rake cycles.

23. The waste toner system of claim 20, wherein the motor forms a part of the waste toner system, and additionally forms a part of an image forming system in the image forming apparatus, the waste toner system further comprising a drive apparatus that drives a media moving member and the toner distributing member in a first motor direction, and drives the media moving member but not the toner distributing member in a second motor direction.

24. The waste toner system of claim 20, wherein the motor comprises a dc motor and wherein the speed control signal comprises a pulse-width-modulated (PWM) output signal generated by the motor control circuit to vary a drive voltage of the dc motor.

25. A waste toner system for use in an image forming apparatus, the waste toner system comprising a shared motor that is configured to drive an image forming process member of the image forming apparatus and drive a toner distributing member that is used to distribute waste toner in a waste toner container.

26. The waste toner system of claim 25, further comprising a motor control circuit to control the shared motor, and a logic circuit to detect accumulation of waste toner in the waste toner container by monitoring the motor control circuit while the shared motor is driving the toner distributing member.

27. The waste toner system of claim 26, wherein the motor control circuit comprises a speed control circuit configured to vary a speed control signal as needed to maintain the shared motor at a desired speed, and wherein the logic circuit monitors the speed control signal to detect accumulation of waste toner within the waste toner container.

28. The waste toner system of claim 26, wherein the motor control circuit comprises a feedback control circuit configured to measure motor speed and to vary a speed control signal as needed to maintain the measured motor speed substantially at a desired motor speed.

29. The waste toner system of claim 25, further comprising a drive apparatus comprising:

a first drive apparatus to drive the image forming process member in forward and reverse directions of the shared motor; and a second drive apparatus to selectively engage the first drive apparatus to thereby drive the toner distributing member in one motor direction but not in the other motor direction.

30. The waste toner system of claim 29, wherein the waste toner system is configured to maintain a first desired motor speed while driving both the image forming process member and the toner distributing member and to maintain a second desired motor speed while driving just the image forming process member.

31. The waste toner system of claim 29, wherein the waste toner system is configured to improve toner distribution by driving the toner distributing member during one or more periods selected so as not to interfere with image forming operations of the image forming apparatus.

32. A method of operation in an image forming apparatus that includes a waste toner system, the method comprising:

using a speed-controlled motor to drive a toner distributing member that distributes waste toner collected in a waste toner container; and detecting accumulation of waste toner based on monitoring a speed control signal that varies as needed to maintain a desired motor speed while driving the toner distributing member.

33. The method of claim 32, wherein detecting accumulation of waste toner based on monitoring a speed control signal comprises detecting an excess accumulation condition based on comparing monitored values of the speed control signal with one or more reference values corresponding to nominal accumulation conditions.

34. The method of claim 32, further comprising sharing the motor between image forming operations and waste toner distributing operations, such that the motor drives the toner distributing member and drives an image forming process member.

35. The method of claim 34, wherein sharing the motor between image forming operations and waste toner distributing operations comprises driving the image forming process member in both forward and reverse directions of the motor and driving the toner distributing member in one of the forward or reverse directions of the motor but not in the other direction.

36. The method of claim 32, wherein the motor is shared between toner distributing operations and image forming process operations, and further comprising selectively driving the toner distributing member such that it is driven when the motor runs in one process direction but not when the motor runs in an opposite process direction.

37. The method of claim 32, wherein the toner distributing member is a reciprocating toner rake, and wherein detecting accumulation of waste toner based on monitoring a speed control signal that varies as needed to maintain a desired motor speed while driving the toner distributing member comprises comparing monitored values of the speed control signal generated over one or more raking cycles to one or more reference values corresponding to nominal accumulation conditions.

38. The method of claim 32, wherein the toner distributing member is a reciprocating toner rake, and wherein detecting accumulation of waste toner based on monitoring a speed control signal that varies as needed to maintain a desired motor speed while driving the toner distributing member comprises detecting a near full condition based on comparing monitored values of the speed control signal generated during forward and reverse movements of the toner rake.

39. The method of claim 38, further comprising generating a near full warning signal.

40. The method of claim 32, wherein the toner distributing member is a reciprocating toner rake, and wherein detecting accumulation of waste toner based on monitoring a speed control signal that varies as needed to maintain a desired motor speed while driving the toner distributing member comprises detecting a full condition based on comparing maximum and minimum monitored values of the speed control signal generated during one or more raking cycles.

41. The method of claim 32, further comprising using the motor to drive an image forming process member in the image forming apparatus, such that the motor is shared between image forming operations and waste toner distributing operations.

42. The method of claim 41, further comprising configuring a drive apparatus to drive both the image forming process member and the toner distributing member in one motor direction and drive just the image forming process member in the other motor direction.

43. The method of claim 32, further comprising locking the toner distributing member responsive to removal of the waste toner container.

44. The method of claim 43, further comprising not energizing the motor responsive to detecting a locked condition of the toner distributing member.

45. A method of operation in an image forming apparatus that includes a waste toner system, the method comprising using a shared motor to drive both an image forming process member used in image forming operations of the image forming apparatus and a toner distributing member used to distribute accumulated waste toner collected in a waste toner container.

46. The method of claim 45, further comprising detecting accumulation of waste toner in the waste toner container based on monitoring a motor control circuit while the shared motor drives the toner distributing member.

47. The method of claim 45, wherein detecting accumulation of waste toner in the waste toner container based on monitoring a motor control circuit while the shared motor drives the toner distributing member comprises monitoring value of a speed control signal that is varied by the motor control circuit as needed to maintain a desired motor speed.

48. The method of claim 45, further comprising configuring the shared motor to drive both the image forming process member and the toner distributing member in one motor direction and to drive just the image forming process member in the other motor direction.

49. The method of claim 45, wherein using a shared motor to drive both an image forming process member used in image forming operations of the image forming apparatus and a toner distributing member used to distribute accumulated waste toner collected in a waste toner container comprises configuring the shared motor to drive a media alignment roller and the toner distributing member in a reverse process direction, and to drive just the media alignment roller in a forward process direction.

50. The method of claim 49, further comprising increasing operating times of the toner distributing member by running the shared motor in the reverse process direction at extra-process times selected not to interfere with the image forming operations.

* * * * *